US009356389B2

(12) United States Patent
Lee et al.

(10) Patent No.: US 9,356,389 B2
(45) Date of Patent: May 31, 2016

(54) VIBRATION PREVENTING DEVICE FOR VIBRATION PREVENTING TYPE LIGHTING FIXTURE

(71) Applicant: Canaan Korea Co. Ltd., Ansan-Si (KR)

(72) Inventors: Wee-Hyung Lee, Uiwang-Si (KR); Min-Soo Kim, Seoul (KR)

(73) Assignee: CANAAN KOREA CO., LTD., Ansan-Si, Gyeonggi-Do (KR)

( * ) Notice: Subject to any disclaimer, the term of this patent is extended or adjusted under 35 U.S.C. 154(b) by 0 days.

(21) Appl. No.: 14/429,664

(22) PCT Filed: Mar. 27, 2014

(86) PCT No.: PCT/KR2014/002627

§ 371 (c)(1),
(2) Date: Mar. 19, 2015

(87) PCT Pub. No.: WO2014/157967

PCT Pub. Date: Oct. 2, 2014

(65) Prior Publication Data

US 2015/0222045 A1 Aug. 6, 2015

(30) Foreign Application Priority Data

Mar. 29, 2013 (KR) ..... 10-2013.0034873

(51) Int. Cl.
*H01R 4/38* (2006.01)
*H01R 13/533* (2006.01)
(Continued)

(52) U.S. Cl.
CPC ..... *H01R 13/533* (2013.01); *F21S 8/00* (2013.01); *F21V 15/04* (2013.01); *H01R 33/9753* (2013.01)

(58) Field of Classification Search
CPC ..... F21V 15/04
USPC ..... 439/382; 362/390, 369
See application file for complete search history.

(56) References Cited

U.S. PATENT DOCUMENTS 3,666,940 A * 5/1972 Magi ..... F21V 15/04 248/560
3,980,878 A * 9/1976 Crompton ..... F21V 15/04 362/375

(Continued)

FOREIGN PATENT DOCUMENTS

JP 2010160949 A 7/2010
KR 200138969 Y1 5/1999

(Continued)

*Primary Examiner* — Vanessa Girardi
(74) *Attorney, Agent, or Firm* — Moser Taboada

(57) ABSTRACT

The present invention relates to a vibration preventing device for a vibration preventing type lighting fixture, which is installed between a socket coupling part of the lighting fixture and a lamp socket coupled to the socket coupling part to protect a lamp from an external vibration or shock. In detail, at least one of buffering protrusions 15, 15' and 15" are formed to protrude on an outer surface, an upper surface and a lower surface of a body 10 of the vibration preventing device and the body is inserted into and coupled with the socket coupling part of the lighting fixture in the state in which the body and the socket are in point-contact with each other by the buffering protrusions formed on the outer surface so that an excellent buffering effect against the external vibration or shock is obtained, and the body 10 has a narrow upper portion and a wide lower portion by gradually increasing the entire width of the body from the upper portion toward the lower portion so that the body is easily inserted and is forcibly inserted in the socket coupling part of the lighting fixture in the form of a wedge, whereby an excellent assembling workability and firm coupling state can be provided.

7 Claims, 8 Drawing Sheets

(51) Int. Cl.

| | |
|---|---|
| ***F21V 15/04*** | (2006.01) |
| ***F21S 8/00*** | (2006.01) |
| ***H01R 33/975*** | (2006.01) |

(56) References Cited

U.S. PATENT DOCUMENTS 4,591,961 A * 5/1986 Myles ..... F21V 15/04 362/306
4,740,876 A * 4/1988 Roller ..... F21V 19/0005 362/306
5,463,541 A * 10/1995 Greene ..... F21S 48/211 362/369
6,334,695 B1 * 1/2002 Abe ..... B64F 1/20 362/153.1
6,635,995 B1 * 10/2003 Blye ..... H01J 5/54 313/292

FOREIGN PATENT DOCUMENTS

KR 100347475 B1 8/2002
KR 1020090111892 A 10/2009

* cited by examiner

VIBRATION PREVENTING DEVICE FOR VIBRATION PREVENTING TYPE LIGHTING FIXTURE

TECHNICAL FIELD

The present invention relates to a vibration preventing device for a vibration preventing type lighting fixture, which is installed between a socket coupling part of the lighting fixture and a lamp socket coupled to the socket coupling part to protect a lamp from an external vibration or shock, and more particularly, to a vibration preventing device for a vibration preventing type lighting fixture, in which buffering protrusions formed to protrude on an outer surface, an upper surface and a lower surface of a body are in point-contact with an inside of the socket coupling part of the lighting fixture to provide an excellent buffering effect against an external vibration or shock and a body has a narrow upper portion and a wide lower portion by gradually increasing the entire width of the body so that the body is easily inserted and is forcibly inserted in the socket coupling part of the lighting fixture in the form of a wedge to provide an excellent assembling workability and firm coupling state.

BACKGROUND

In general, a vibration preventing structure which can protect a lamp from an external vibration or shock is provided in a lighting fixture installed in a room or an outdoor area.

In particular, the vibration preventing structure is provided between a socket and a lamp of a lighting fixture such as, for example, a street lighting fixture, a tunnel lighting fixture, a flood lighting fixture, an inspection lighting fixture, a scene lighting fixture, a fluorescent light fixture, and has a socket structure to prevent a damage to the lamp caused by a vibration and a shock which are generated due to external environmental factors according to natural environments such as wind and a self-vibration caused by a climate and installation sites (for example, a bridge, an elevated road, a tunnel, an underground roadway, a large structure, a crane, an inside of a factory and the like).

In the conventional vibration preventing type lighting fixture, similar to the disclosure disclosed in Korean Utility Model Registration No. 20-394239, a buffering member is inserted between a socket coupling part of the lighting fixture and a lamp socket coupled to the socket coupling part to protect the lamp from the external vibration or shock.

However, the buffering member alleviates the shock using a material characteristic, for example, the material property of rubber material, rather than a structural characteristic.

Of course, a buffering groove is formed in the buffering member. However, since the buffering member has a structure configured to be entirely in contact with the socket coupling part of the lighting fixture and the lamp socket, the buffering member does not alleviate sufficiently the external vibration or shock so that the protection capability of the lamp is unnecessarily lowered.

In addition, since the above conventional buffering member has a structure which is merely inserted in the socket coupling part of the lighting fixture, if a size of the buffering member is similar to that of the socket coupling part to tightly insert the buffering member in the socket coupling part, it is difficult to perform an assembling process. On the contrary, if the buffering member is loosely coupled to the socket coupling part, there is a concern that the buffering member will separate from the socket coupling part after assembling.

In addition to the above, since the conventional buffering member is configured to be divided into an upper part and a lower part for an assembling process, the upper and lower parts are manufactured through separate molds so that a manufacturing process is complicated. In addition, since a plurality of buffering members are assembled sequentially, an assembling workability becomes more complicated.

BRIEF DESCRIPTION OF THE INVENTION

Technical Task

The present invention is invented to solve the problems of the above conventional technology, an object of the present invention is to provide a vibration preventing device in which buffering protrusions formed to protrude on an outer surface, an upper surface and a lower surface of a body are in point-contact with an inside of a socket coupling part of a lighting fixture to provide an excellent buffering effect against an external vibration or shock and the body has a narrow upper portion and a wide lower portion by gradually increasing the entire width of the body so that the body is easily inserted and is forcibly inserted in the socket coupling part of the lighting fixture in the form of a wedge to provide an excellent assembling workability and firm coupling state.

Another object of the present invention is to provide a vibration preventing device in which the body has an integrated structure, cutting grooves are formed at equal angles on an outer circumference of a lower portion of the body to form divided parts so that the divided parts are elastically and closely in contact with each other to provide an excellent coupling workability and firm coupling state when the body is inserted in and coupled to the socket coupling part of the lighting fixture.

Further another object of the present invention is to provide a vibration preventing device in which the body has a divided structure to provide an excellent formability and divided bodies are elastically contacted with other inwardly and outwardly by contact protrusions and wings formed at outside ends at which the divided bodies are in contact with each other to provide an excellent coupling workability and firm coupling state when the body is inserted in and coupled to the socket coupling part of the lighting fixture.

Technical Solution

The present invention as above is characterized in that at least one buffering protrusion is formed to protrude on an outer surface, an upper surface and a lower surface of a body of a vibration preventing device installed between a socket coupling part of a lighting fixture and a lamp socket and protecting a lamp from an external vibration or shock, the body is inserted into and coupled with the socket coupling part 3 of the lighting fixture in the state in which the body and the socket are in point-contact with each other by the buffering protrusions formed on the outer surface, the upper surface and the lower surface, the body has a narrow upper portion and a wide lower portion by gradually increasing the entire width of the body from the upper portion toward the lower portion so that the lower portion is forcibly inserted in the socket coupling part of the lighting fixture, rather than the upper portion, to allow the body to be coupled to the socket coupling part.

The present invention is characterized in that the body has a polygonal cross-section or circular-section.

The present invention is characterized in that the body is radially divided at regular angular intervals around a center in a vertical direction into divided bodies, contact protrusions are formed at ends of outside of contact surfaces of the divided bodies, which are in contact with each other, and the contact protrusions are inclined inward and are closely in contact with each other, and an inner groove is formed between the divided body and the contact protrusion so that the contact protrusions are elastically and closely in contact with each other.

The present invention is characterized in that the body has an integrated structure, cutting grooves are formed at equal angles on an outer circumference of a lower portion of the body in the vertical longitudinal direction to form divided parts so that the divided parts are elastically and closely in contact with each other.

The present invention is characterized in that a plurality of buffering protrusions formed on the outer circumference surface of the body are uniformly distributed on the outer circumference surface of the body in a circumferential direction and a vertical lengthwise direction, each buffering protrusion has a circular cone shape having a flatness of the cutting edge and a height of the buffering protrusion is greater than that of the buffering protrusion located thereabove.

Advantageous Effect

The present invention configured as above is advantageous in that the buffering protrusions are formed to protrude on an outer surface, an upper surface and a lower surface of the body installed between the socket coupling part of the lighting fixture and the lamp socket and the body is coupled to the socket coupling part of the lighting fixture in the state in which the buffering protrusions are in point-contact with an outer side, upper and lower sides of the socket coupling part of the lighting fixture to provide an excellent buffering effect against an external vibration or shock and to secure a durability of the lamp against a vibration and a shock, and the body has a narrow upper portion and a wide lower portion so that the body is easily inserted and is forcibly inserted in the socket coupling part of the lighting fixture in the form of a wedge to provide an excellent assembling workability and firm coupling state.

In addition, the present invention configured as above is advantageous in that, in the integrated body, due to the cutting grooves which are formed at equal angles on an outer circumference of a lower portion of the body to form divided parts, the divided parts are elastically and closely in contact with each other, and in the divided body structure, the divided bodies are elastically contacted with other inward and outward by the contact protrusions and the wings formed on portions at which the divided bodies are in contact with each other so that the lower portion of the body is forcibly coupled to the socket coupling part of the lighting fixture, rather than the upper portion, to provide an excellent coupling workability and firm coupling state when the body is inserted in and coupled to the socket coupling part of the lighting fixture.

BEST MODE FOR CARRYING OUT THE INVENTION

Figure 1:
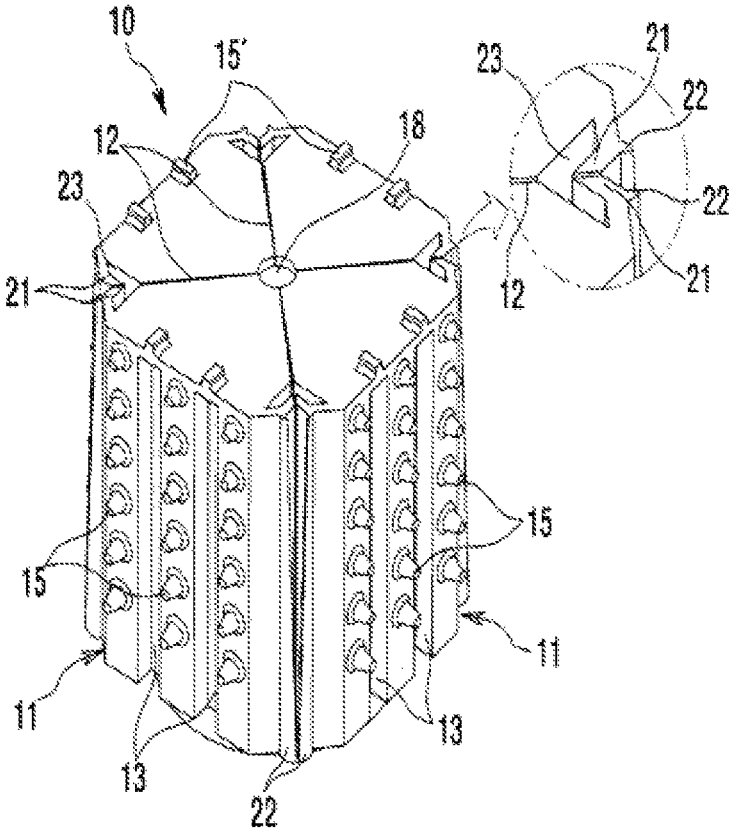
FIG. 1 is a perspective view showing one embodiment of a vibration preventing device of the present invention.
Figure 2:
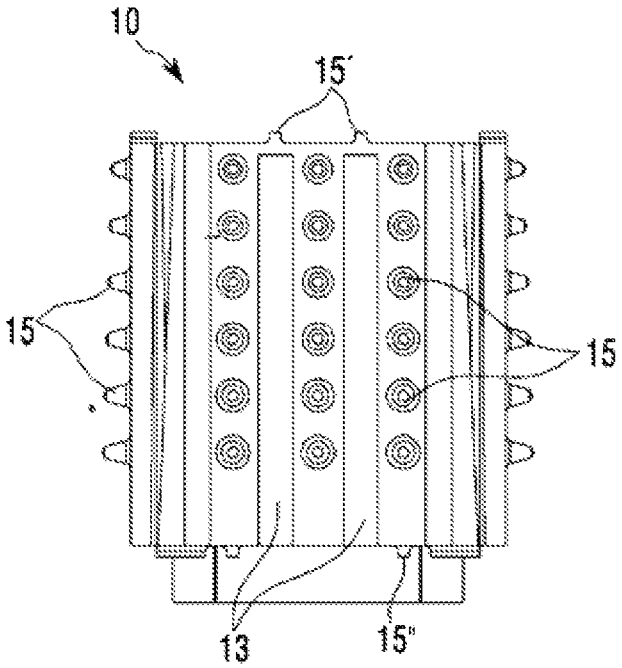
FIG. 2 is a front view of FIG. 1.
Figure 3:
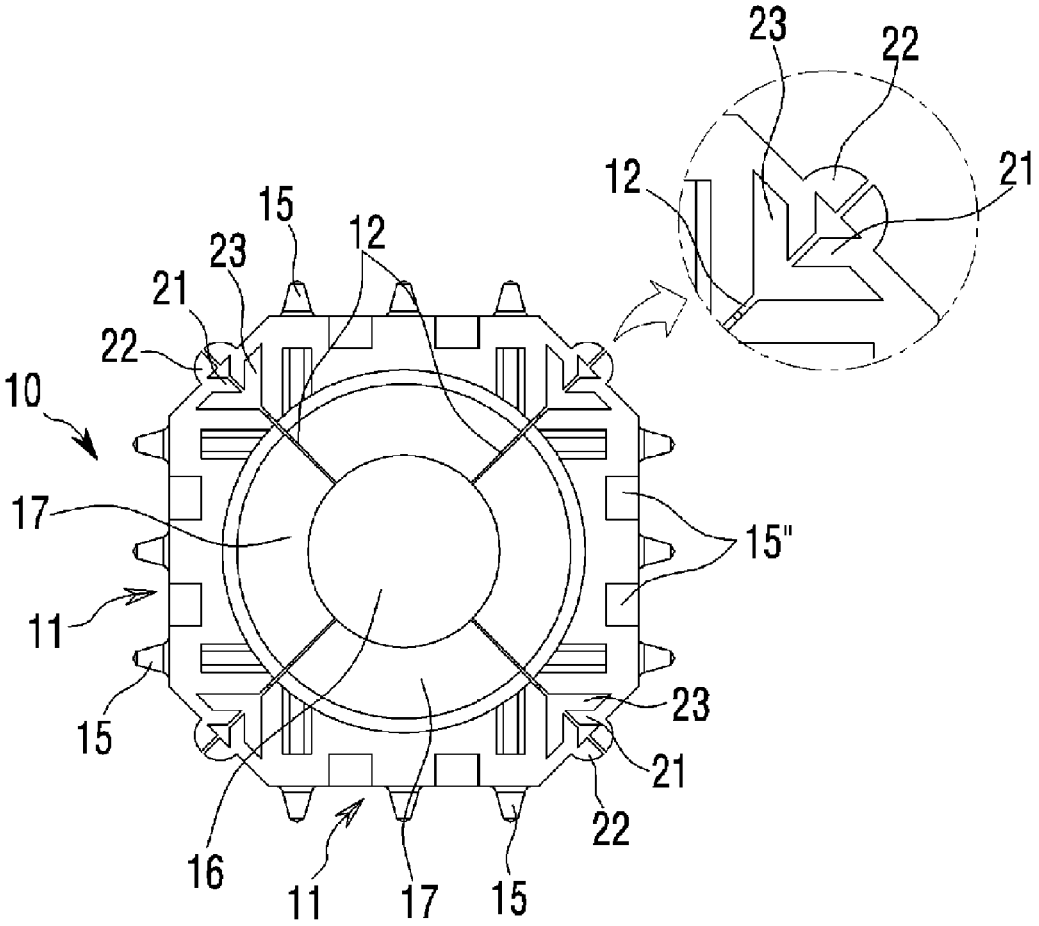
FIG. 3 is a bottom view of FIG. 1.
Figure 4:
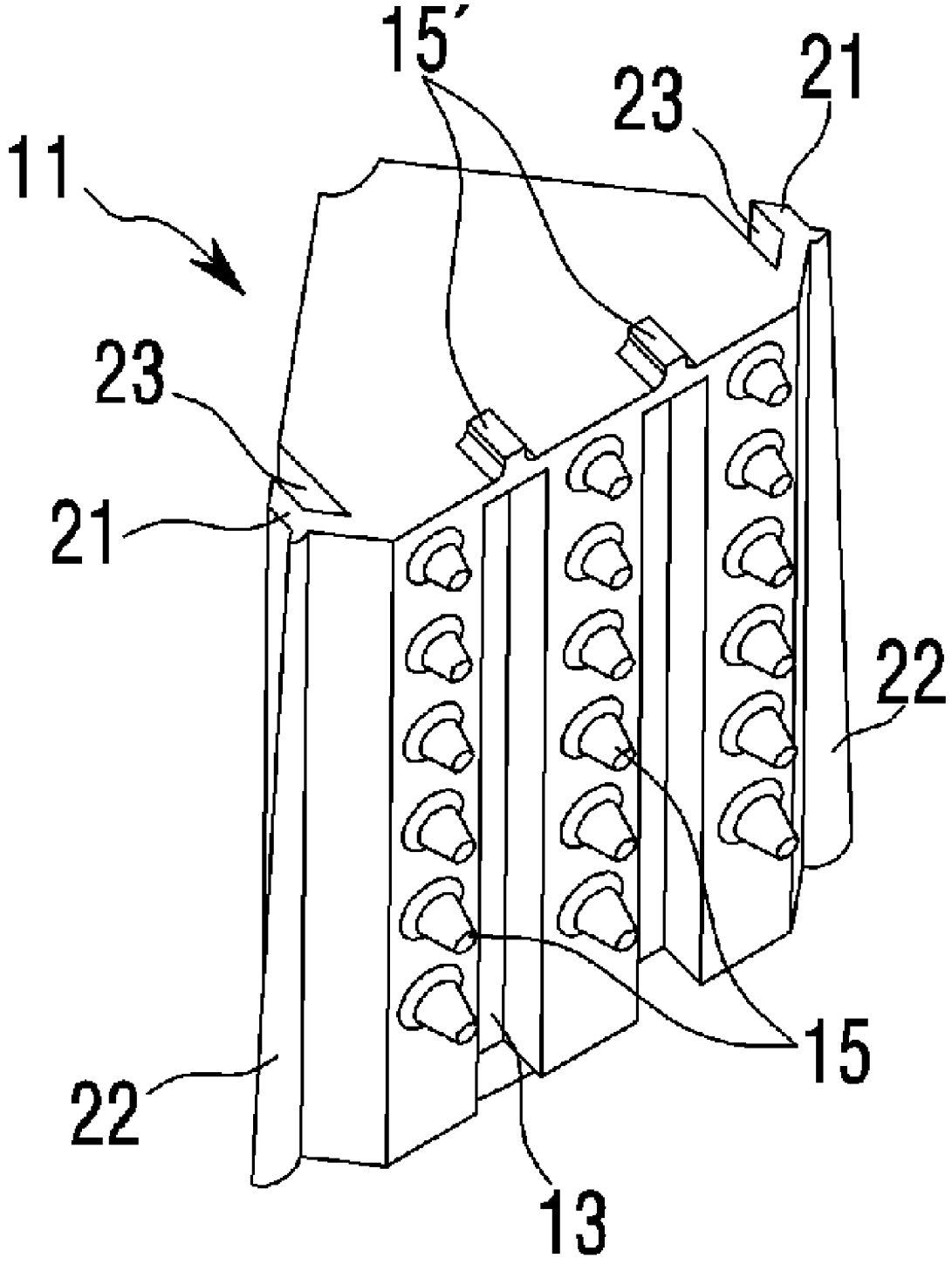
FIG. 4 is a perspective view of a divided body of FIG. 1.

Hereinafter, the present invention will be described in more detail with reference to the accompanying drawings.

As shown in FIG. 1 to FIG. 8, a vibration preventing device for a socket of a vibration preventing type lighting fixture is provided between a socket coupling part 3 of a light fixture 2 and a lamp socket 4 coupled to the socket coupling part to protect a lamp 5 from an external vibration or shock. In other words, the vibration preventing device of the present invention is configured so that at least one of buffering protrusions 15, 15' and 15" are formed to protrude on an outer surface, an upper surface and a lower surface of a body 10 formed of shock-buffering material such as rubber, the body is inserted into and coupled with the socket coupling part 3 of the lighting fixture in the state in which the body and the socket are in point-contact with each other due to the buffering protrusions formed on the outer surface, the upper surface and the lower surface. Here, the body 10 has a narrow upper portion and a wide lower portion by gradually increasing the entire width of the body 10 from the upper portion toward the lower portion so that the lower portion is forcibly inserted in the socket coupling part 3 of the lighting fixture, rather than the upper portion, to allow the body to be coupled to the socket coupling part.

Figure 7:
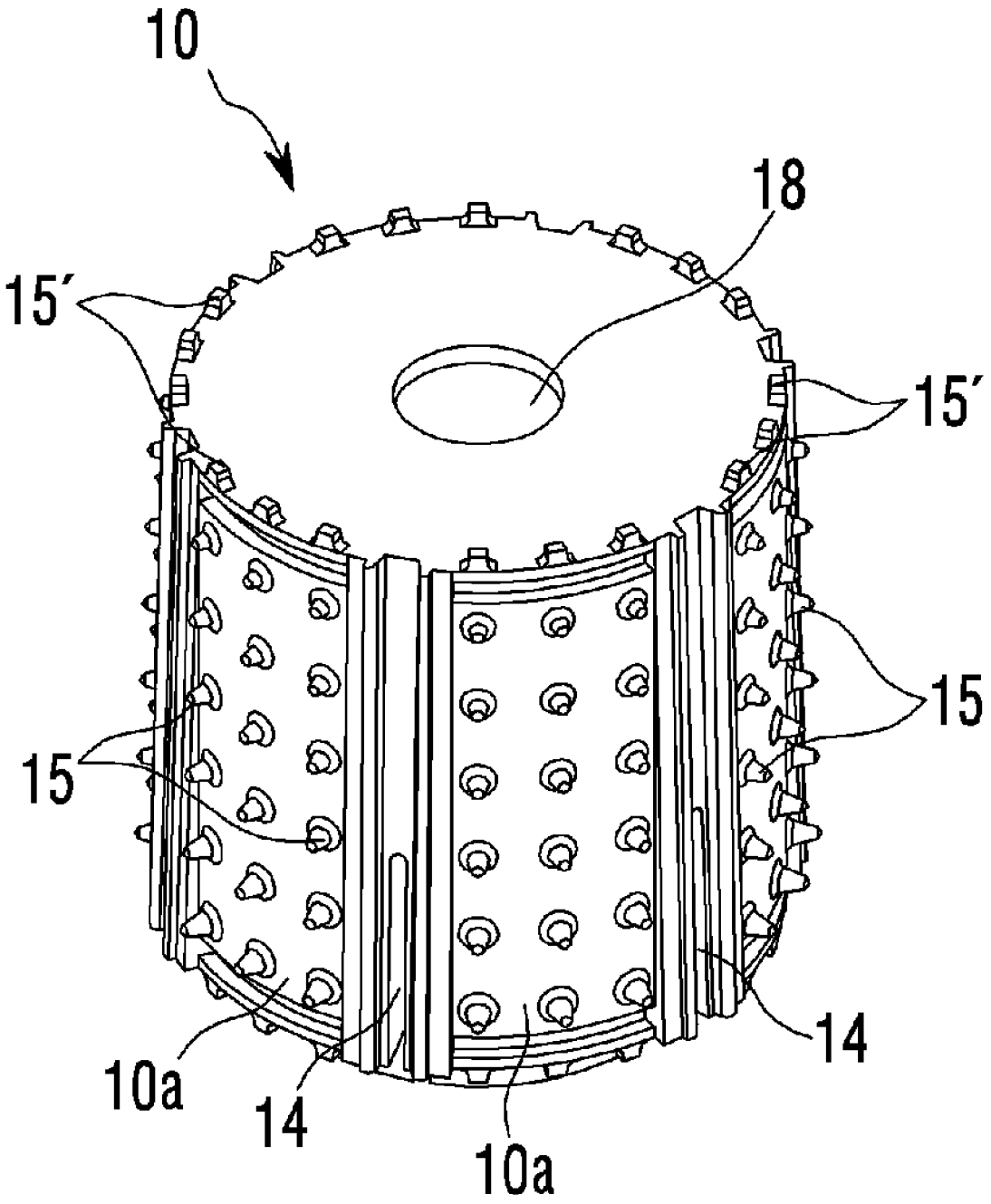
FIG. 7 is a perspective view showing another embodiment of a vibration preventing device of the present invention.

At this time, even though it is preferable that the body 10 has a rectangular cross-section as shown in FIG. 1, it goes without saying, as shown in FIG. 7, the body may have a polygonal cross-section such as a triangular, pentagonal, hexagonal or octagonal cross-section, and the body may be configured to have a circular cross-section.

Figure 8:
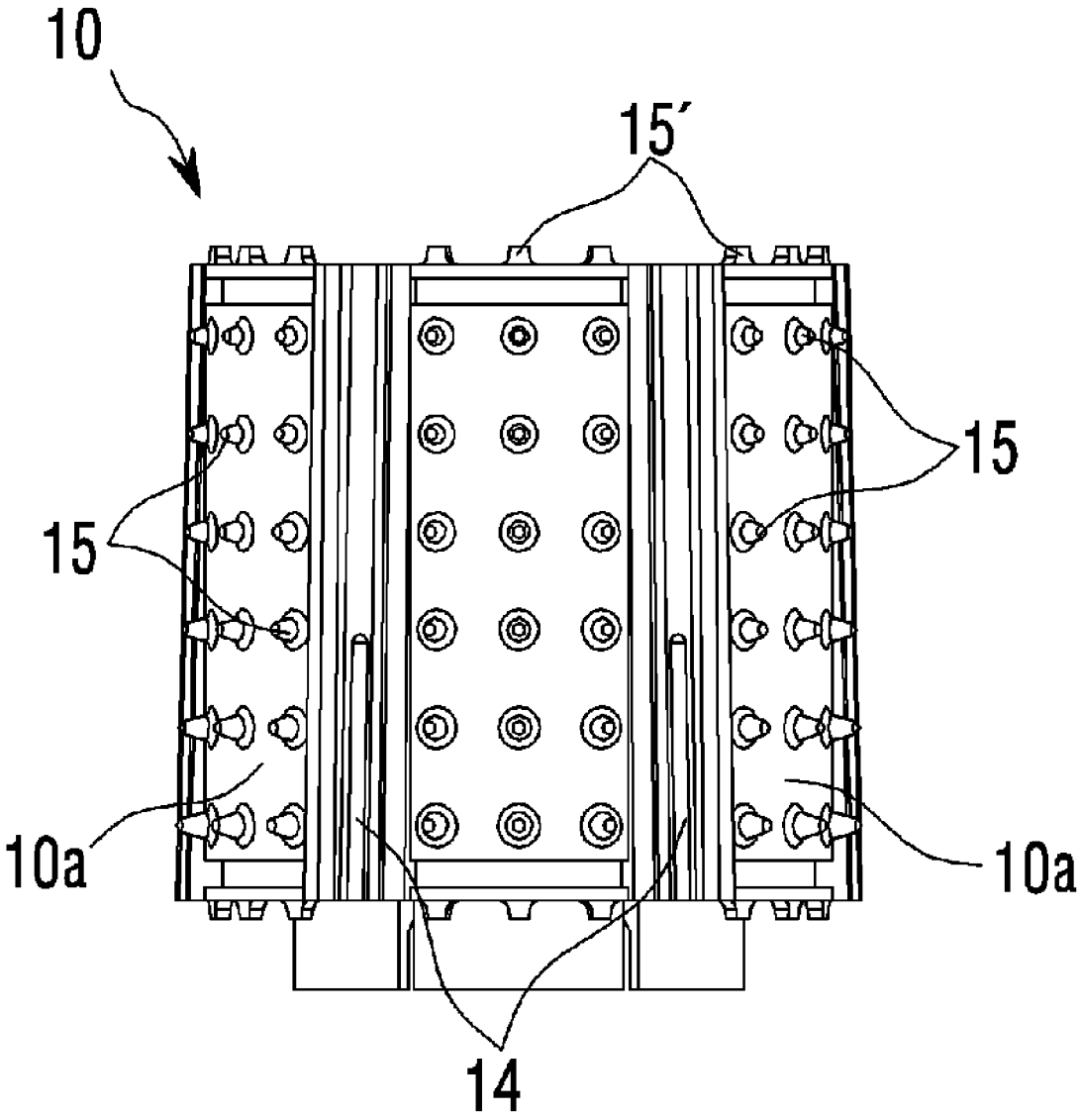
FIG. 8 is a front view of FIG. 7.

In addition, the body 10 is configured to have a divided body structure in which the body is radially divided at regular angular intervals around a center in a vertical direction as shown in FIG. 1 to FIG. 4 or to have an integrated structure as shown in FIG. 7 and FIG. 8.

In the divided body structure, divided bodies 11, obtained by dividing the body 10 into equal angles, are inserted into and coupled to the socket coupling part 3, inner grooves 23 are formed between the divided bodies 11 and contact protrusions 21 and the contact protrusions 21 are pushed into the inner groove so that the contact protrusions 21 are elastically and closely in contact with each other.

In addition, a wing 22 is formed on an outer surface of the contact protrusion 21 of the divided body 11, and the wing is protruded outward and contacts a wing of another divided body adjacent thereto. Here, the wing 22 is inclined so that a distance between two wings of the divided bodies adjacent to each other is gradually decreased from an upper portion toward a lower portion, and the wings are thus elastically and closely contacted with each other and pushed outward.

In other words, due to the contact protrusion 21 and the wing 22 facing each other and formed at an outer end of a contact surface 12 of the divided body 11, when the body 10 is inserted in the socket coupling part 3 of the lighting fixture, the contact protrusion and the wing are elastically and closely in contact with each other inwardly and outwardly and inserted in the socket coupling part.

In addition, in the integrated body 10, cutting grooves 14 are formed at equal angles on a circumference of a lower portion in the vertical longitudinal direction to form divided parts 10*a* so that the divided parts are elastically and closely in contact with each other.

In addition to the above, a plurality of buffering protrusions 15 formed on the outer circumference surface of the body 10 are uniformly distributed on the outer circumference surface of the body 10 in a circumferential direction and a vertical lengthwise direction, and each buffering protrusion 15 has a circular cone shape having a flatness of the cutting edge. Here, a height of the buffering protrusion 15 is greater than that of the buffering protrusion located thereabove.

In addition, the body 10 has an inserting hole 16 formed at a lower portion thereof, a contact piece 17 is formed at an inlet of the inserting hole and protruded inward so that when the lamp 5 is assembled, the contact piece is bent and then tightly inserted between the socket and the lamp.

Reference numerals 13 and 18, which are not described, represent a buffering groove formed for a buffering operation and a wiring space, respectively.

Next, an operation and an effect of the present invention configured as above are illustrated.

Figure 5:
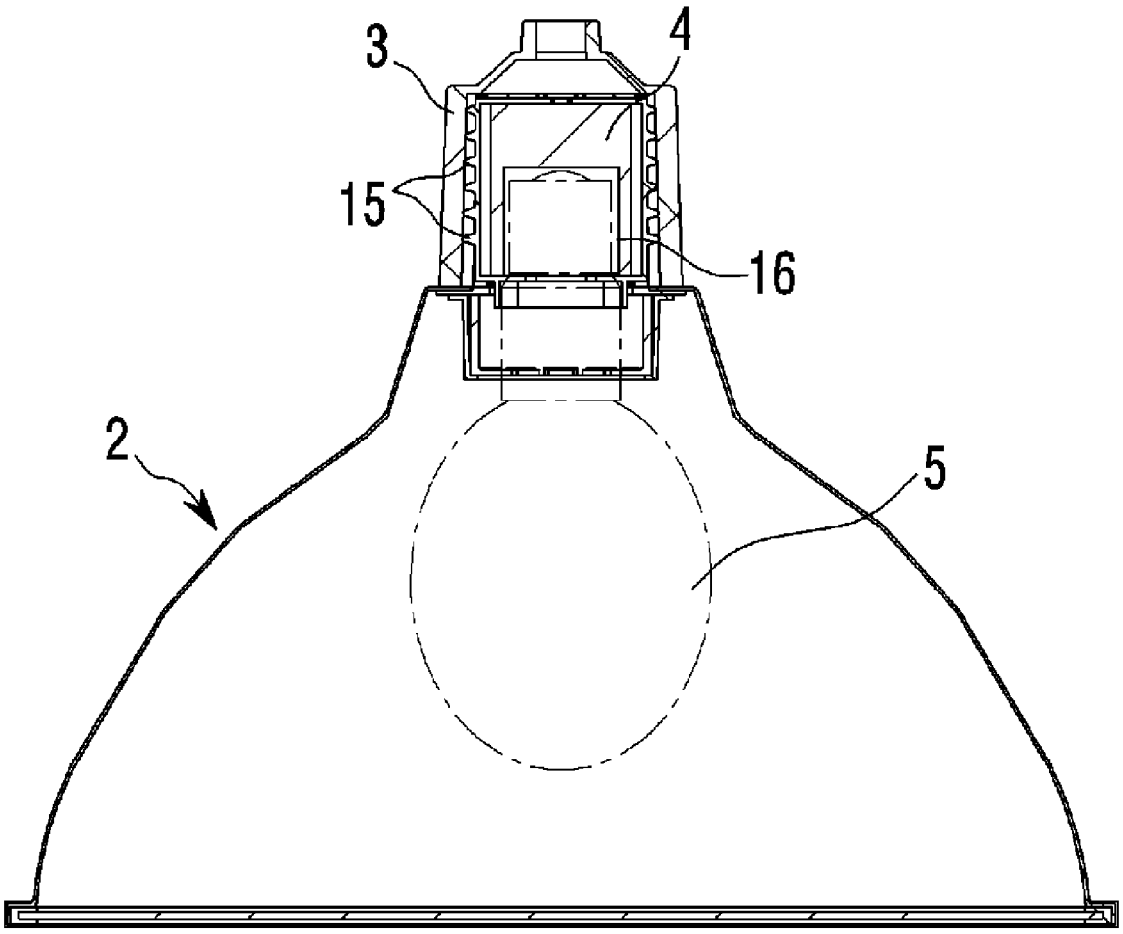
FIG. 5 is a cross sectional view of a light fixture showing a state in which a vibration preventing device of FIG. 1 is installed.
Figure 6:
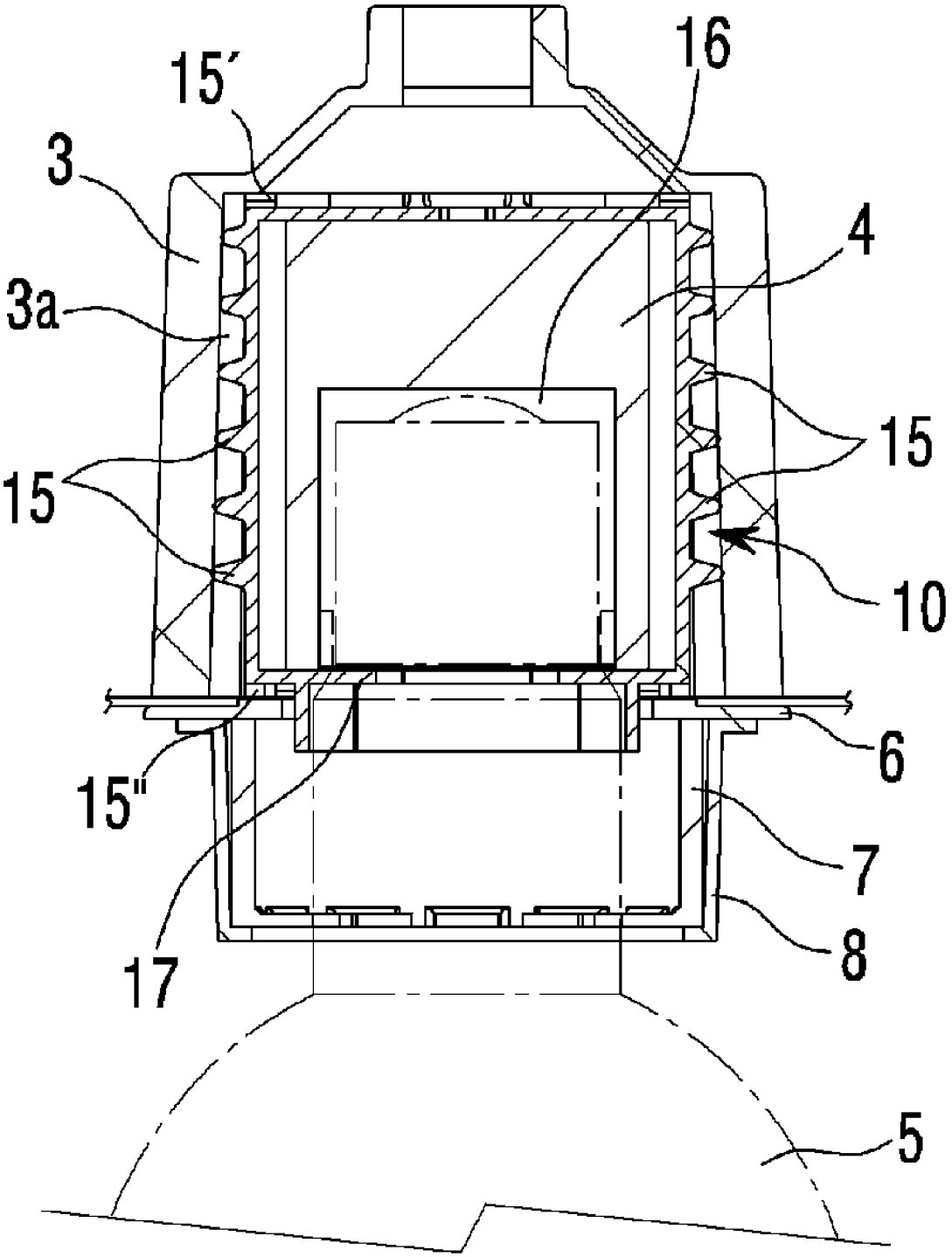
FIG. 6 is an enlarged view of FIG. 5.

First, a process for assembling and installing the vibration preventing device of the present invention is described. As shown in FIG. 5 and FIG. 6, the vibration preventing device is inserted into a coupling recess 3*a* formed in the socket coupling part 3 of the lighting fixture 2 to couple the vibration preventing device to the socket coupling part.

At this time, the body 10 of the vibration preventing device is formed to have an integrated configuration or a divided body configuration in which the body is radially divided at regular angular intervals around a center in a vertical direction.

The divided body configured vibration preventing device is mainly described below. Since the body 10 has a narrow upper portion and a wide lower portion by gradually increasing the entire width of the body from the upper portion toward the lower portion and a height of the buffering protrusion 15 formed on an outer circumference surface of the body 10 is greater than that of the buffering protrusion 15 located thereabove, when the body 10 is inserted into the socket coupling part 3 of the lighting fixture, the upper portion of the body is easily inserted in the coupling recess 3*a* of the socket coupling part 3 and the lower portion of the body is forcibly inserted in the coupling recess in the form of a wedge and then coupled to the socket coupling part.

At this time, it is more preferable that the coupling recess 3*a* of the socket coupling part 3 is also inclined to have a narrow upper portion and a wide lower portion.

In addition, in the body 10, the contact protrusions 21 inclined inward at outer ends of the contact surfaces 12, at which the divided bodies 11 are in contact with each other, are closely in contact with each other, the contact protrusions 21 are elastically deformed due to the inner groove 23 formed between the divided body 11 and the contact protrusion. Here, the contact protrusion formed on a lower portion is more elastically in contact with the socket coupling part than the contact protrusion formed on an upper portion so that the body is easily and forcibly coupled to the socket coupling part.

At the same time, since the wing 22 formed on an outer surface of the contact protrusion 21 and protruded outward is inclined to allow a distance between two adjacent wings to be gradually decreased from an upper portion toward a lower portion, the wings 22 are thus gradually and elastically contacted with each other from a lower portion toward an upper portion so that the body is easily and forcibly coupled to the socket coupling part.

In other words, due to the entire structure in which the upper portion is narrow and the lower portion is wide and the contact protrusion 21 and the wing 22 facing each other and formed at an outer end of the contact surface 12 of the divided body 11, the body 10 is elastically in contact with the socket coupling part and is inserted in the socket coupling part in the form of a wedge, an insertion process is easily performed when the body is inserted in the socket coupling part 3 of the lighting fixture and the excellent coupling solidity can be secured.

After inserting the body 10 of the vibration preventing device in the socket coupling part 3 of the lighting fixture 2 as above, a sealing member 6, a lamp supporting piece 7 and an external cover 8 are coupled and assembled to the light fixture 2.

The body 10 of the vibration preventing device of the present invention assembled as above is coupled to the socket coupling part 3 of the lighting fixture in the point-contact state caused by the buffering protrusions 15, 15' and 15" which are formed to protrude on the outer surface, the upper surface and the lower surface of the body, respectively.

In this coupled state, the lamp 5 is coupled to and installed in the lamp socket 4 in the body 10 of the vibration preventing device.

In the lighting fixture assembled and installed as above, when an external vibration or an external shock is applied to the lighting fixture, since the body 10 of the vibration preventing device buffers the vibration or shock in the socket coupling part 3 of the lighting fixture in the state in which the buffering protrusions 15, 15' and 15", which are formed to protrude on the outer surface, the upper surface and the lower surface of the body, are in point-contact with the socket coupling part, an excellent buffering effect is provided.

In addition, the contact protrusions 21 inclined inward at outer ends of the contact surfaces 12, at which the divided bodies 11 are in contact with each other, are pushed inward and elastically deformed due to the inner groove 23 and the wing 22 formed outward at an outer end of the contact surface 12 is elastically and outwardly deformed to additionally perform a shock buffering on the divided body 11. Therefore, a superior vibration or shock buffering effect is provided.

In addition, in the present invention, in the case in which the body 10 of the vibration preventing device is not divided into a plurality of bodies, but has the integrated structure, since the body has the structure in which the upper portion is narrow and the lower portion is wide, the upper portion of the body is easily inserted in the socket coupling part 3 of the lighting fixture and the lower portion is forcibly inserted in and coupled to the socket coupling body in the form of the wedge.

Furthermore, since the buffering protrusions 15, 15' and 15" which are formed to protrude on an outer surface, an upper surface and a lower surface of the body 10 buffers a vibration or a shock in the state in which the buffering protrusions are in point-contact with the surface of the socket coupling part, an excellent buffering effect is obtained. Also, since the cutting grooves 14 are formed at equal angles on a circumference of the lower portion of the body in the vertical longitudinal direction to form the divided parts 10*a* and the divided parts are elastically and closely in contact with each other, the shock buffering action is additionally performed on each divided part to provide an excellent vibration or shock buffering effect.

INDUSTRIAL APPLICABILITY

The present invention can be applied to the lighting fixture installed in a room or an outdoor area as the vibration preventing structure which can protect the lamp from an external vibration or shock.

REFERENCE NUMERALS

10: Body
14: Cutting groove
15, 15', 15": Buffering protrusion
11: Divided body
12: Contact surface
21: Contact protrusion
22: Wing
23: Groove

The invention claimed is:

1. A vibration preventing device for a vibration preventing type lighting fixture, which is installed between a socket coupling part of the lighting fixture and a lamp socket coupled to the socket coupling part to protect a lamp from an external vibration or shock, characterized in that at least one of buffering protrusions are formed to protrude on an outer surface, an upper surface and a lower surface of a body formed of shock-buffering material, the body is inserted into and coupled with the socket coupling part of the lighting fixture in the state in which the body and the socket are in point-contact with each other by the buffering protrusions formed on the outer surface, the upper surface and the lower surface, the body has a narrow upper portion and a wide lower portion by gradually increasing the entire width of the body from the upper portion toward the lower portion so that the lower portion is forcibly inserted in the socket coupling part of the lighting fixture, rather than the upper portion, to allow the body to be coupled to the socket coupling part.

2. The vibration preventing device for a vibration preventing type lighting fixture of claim 1, wherein the body has a polygonal cross-section.

3. The vibration preventing device for a vibration preventing type lighting fixture of claim 1, wherein the body has a circular cross-section.

4. The vibration preventing device for a vibration preventing type lighting fixture of any one of claim 1, wherein the body has an integrated structure, cutting grooves are formed at equal angles on an outer circumference of a lower portion of the body in the vertical longitudinal direction to form divided parts so that the divided parts are elastically and closely in contact with each other.

5. The vibration preventing device for a vibration preventing type lighting fixture of any one of claim 1, wherein a plurality of buffering protrusions formed on the outer circumference surface of the body are uniformly distributed on the outer circumference surface of the body in a circumferential direction and a vertical lengthwise direction, each buffering protrusion has a circular cone shape having a flatness of the cutting edge, and a height of the buffering protrusion is greater than that of the buffering protrusion located thereabove.

6. The vibration preventing device for a vibration preventing type lighting fixture of any one of claim 1, wherein the body is radially divided at regular angular intervals around a center in a vertical direction into divided bodies, contact protrusions are formed at ends of outsides of contact surfaces of the divided bodies, which are in contact with each other, and the contact protrusions are inclined inward and are closely in contact with each other, and an inner groove is formed between the divided body and the contact protrusion and the contact protrusions are pushed into the inner grooves so that the contact protrusions are elastically and closely in contact with each other.

7. The vibration preventing device for a vibration preventing type lighting fixture of claim 6, wherein a wing is formed on an outer surface of the contact protrusion of the divided body, the wing is protruded outward and contacts a wing of another divided body adjacent thereto, and the wing is inclined so that a distance between two wings of the divided bodies adjacent to each other is gradually decreased from an upper portion toward a lower portion, and the wings are thus elastically and closely contacted with each other and pushed outward.

* * * * *